US006206374B1

(12) United States Patent
Jones

(10) Patent No.: US 6,206,374 B1
(45) Date of Patent: Mar. 27, 2001

(54) METHODS OF PLAYING POKER GAMES

(75) Inventor: Daniel A. Jones, Las Vegas, NV (US)

(73) Assignee: Progressive Games, Inc., Las Vegas, NV (US)

( * ) Notice: Subject to any disclaimer, the term of this patent is extended or adjusted under 35 U.S.C. 154(b) by 0 days.

(21) Appl. No.: 09/376,930

(22) Filed: Aug. 16, 1999

Related U.S. Application Data

(63) Continuation of application No. 08/910,863, filed on Aug. 13, 1997, now Pat. No. 5,964,464, which is a continuation of application No. 08/542,817, filed on Oct. 13, 1995, now Pat. No. 5,725,216.

(51) Int. Cl.[7] ..... A63F 1/00
(52) U.S. Cl. ..... 273/292
(58) Field of Search ..... 273/292, 309, 273/274; 463/12, 13, 26–29

(56) References Cited

U.S. PATENT DOCUMENTS

| | | | |
|---|---|---|---|
| D. 105,610 | 8/1937 | Posey | D6/618 |
| D. 118,451 | 1/1940 | Radford | D21/26 |
| D. 183,007 | 6/1958 | Lord | D21/26 |

FOREIGN PATENT DOCUMENTS

| | | |
|---|---|---|
| 621599 | 4/1989 | (AU) . |
| 628044 | 4/1989 | (AU) . |
| 96049 | 4/1989 | (AT) . |

(List continued on next page.)

OTHER PUBLICATIONS

Winning Gamer, Issue #5, Feb. 1985, Pi Yee Press, LaJolla, CA.

Winning Gamer, Issue #6, Mar. 1985, Pi Yee Press, LaJolla, CA.

Winning Gamer, Issue #15, Dec. 1985, Pi Yee Press, LaJolla, CA.

(List continued on next page.)

*Primary Examiner*—Benjamin H. Layno

(57) ABSTRACT

The present invention relates to methods for playing seven card stud and five card draw poker variants including an optional progressive jackpot feature, and more particularly relates to particular variations of the CARIBBEAN STUD (registered trademark) poker variant disclosed in U.S. Pat. No. 4,836,553 and including an optional progressive jackpot component as disclosed in U.S. Pat. Nos. 4,861,041 and 5,078,405.

18 Claims, 2 Drawing Sheets

U.S. PATENT DOCUMENTS

| | | | |
|---|---|---|---|
| D. 213,891 | 4/1969 | Schultz | D21/32 |
| D. 220,635 | 5/1971 | Boyer et al. | D21/30 |
| D. 245,717 | 9/1977 | Jessie | D21/32 |
| D. 263,975 | 4/1982 | Quisuga et al. | D21/37 |
| D. 311,474 | 10/1990 | Hoffman | D6/618 |
| 1,238,736 | 9/1917 | Barrett | 453/18 |
| 1,527,929 | 2/1925 | Simons | 273/274 |
| 1,763,476 | 6/1930 | Morris | 273/309 |
| 1,970,876 | 8/1934 | Anderson | 273/309 |
| 2,008,829 | 7/1935 | Israel | 273/148 A |
| 2,199,745 | 5/1940 | Harris | 273/309 |
| 3,011,789 | 12/1961 | Eliassen et al. | 273/148 R |
| 3,269,503 | 8/1966 | Foster | 463/26 |
| 3,556,531 | 1/1971 | Elder | 273/143 R |
| 3,663,021 | 5/1972 | Whippo | 273/274 |
| 3,667,757 | 6/1972 | Holmberg | 273/274 |
| 3,689,071 | 9/1972 | Kucera | 273/281 |
| 3,796,433 | 3/1974 | Fraley et al. | 463/18 |
| 3,825,255 | 7/1974 | Kennard et al. | 273/139 |
| 3,874,671 | 4/1975 | Smith | 273/254 |
| 3,876,208 | 4/1975 | Wachtler et al. | 463/13 |
| 3,998,462 | 12/1976 | Gootl | 273/437 |
| 4,063,680 | 12/1977 | Leo | 232/1 D |
| 4,099,722 | 7/1978 | Rodesch et al. | 273/143 R |
| 4,232,866 | 11/1980 | Pennachio | 273/374 |
| 4,302,012 | 11/1981 | Di Giovanni et al. | 273/148 R |
| 4,305,586 | 12/1981 | Richards | 273/274 |
| 4,312,508 | 1/1982 | Wood | 273/274 |
| 4,364,567 | 12/1982 | Gootl | 273/237 |
| 4,397,469 | 8/1983 | Carter, III | 273/149 R |
| 4,518,001 | 5/1985 | Branham | 453/49 |
| 4,531,187 | 7/1985 | Uhland | 364/410 |
| 4,569,526 | 2/1986 | Hamilton | 273/242 |
| 4,575,085 | 3/1986 | Ollington | 273/138.1 |
| 4,614,342 | 9/1986 | Takashima | 463/11 |
| 4,624,459 | 11/1986 | Kaufman | 273/143 R |
| 4,648,604 | 3/1987 | Horan | 273/292 |
| 4,651,997 | 3/1987 | Wood | 273/274 |
| 4,666,160 | 5/1987 | Hamiton | 273/242 |
| 4,700,948 | 10/1987 | Okada | 273/143 R |
| 4,721,307 | 1/1988 | Okada | 273/143 R |
| 4,743,022 | 5/1988 | Wood | 463/13 |
| 4,756,531 | 7/1988 | DiRe et al. | 273/274 |
| 4,759,549 | 7/1988 | Beckwith | 273/274 |
| 4,760,527 | 7/1988 | Sidley | 364/412 |
| 4,813,675 | 3/1989 | Greenwood | 463/46 |
| 4,836,546 | 6/1989 | DiRe et al. | 463/18 |
| 4,836,553 | 6/1989 | Suttle et al. | 273/292 |
| 4,837,728 | 6/1989 | Barrie et al. | 364/412 |
| 4,861,041 | 8/1989 | Jones et al. | 273/292 |
| 4,926,327 | 5/1990 | Sidley | 364/412 |
| 4,948,134 | 8/1990 | Suttle et al. | 463/13 |
| 4,964,638 | 10/1990 | Ishida | 463/27 |
| 5,007,519 | 4/1991 | Mercurio | 194/230 |
| 5,019,973 | 5/1991 | Wilcox et al. | 364/412 |
| 5,022,653 | 6/1991 | Suttle et al. | 463/13 |
| 5,042,818 | 8/1991 | Weingardt | 273/292 |
| 5,078,405 | 1/1992 | Jones et al. | 273/309 |
| 5,092,598 | 3/1992 | Kamille | 273/139 |
| 5,098,107 | 3/1992 | Boylan et al. | 273/292 |
| 5,100,137 | 3/1992 | Fulton | 463/13 |
| 5,106,089 | 4/1992 | Wood | 273/139 |
| 5,112,060 | 5/1992 | Jones | 273/309 |
| 5,154,429 | 10/1992 | Le Vasseur | 273/292 |
| 5,167,413 | 12/1992 | Fulton | 463/13 |
| 5,248,142 | 9/1993 | Breeding | 273/138.1 |
| 5,249,800 | 10/1993 | Hilgendorf et al. | 463/27 |
| 5,251,897 | 10/1993 | Fulton | 463/13 |
| 5,255,915 | 10/1993 | Miller | 463/13 |
| 5,257,784 | 11/1993 | Boylan et al. | 273/138.1 |
| 5,257,810 | 11/1993 | Schorr et al. | 273/292 |
| 5,265,877 | 11/1993 | Boylan et al. | 273/139 |
| 5,275,400 | 1/1994 | Weingardt et al. | 463/12 |
| 5,275,411 | 1/1994 | Breeding | 273/149 R |
| 5,275,415 | 1/1994 | Wisted | 273/274 |
| 5,277,424 | 1/1994 | Wilms | 463/12 |
| 5,286,023 | 2/1994 | Wood | 273/138.2 |
| 5,288,077 | 2/1994 | Jones | 273/292 |
| 5,288,081 | 2/1994 | Breeding | 273/292 |
| 5,294,128 | 3/1994 | Marquez | 273/292 |
| 5,322,295 | 6/1994 | Cabot et al. | 273/292 |
| 5,364,104 | 11/1994 | Jones et al. | 273/292 |
| 5,364,105 | 11/1994 | Jones | 273/292 |
| 5,374,067 | 12/1994 | Jones | 273/292 |
| 5,377,973 | 1/1995 | Jones | 273/292 |
| 5,377,994 | 1/1995 | Jones | 273/292 |
| 5,380,012 | 1/1995 | Jones et al. | 273/292 |
| 5,382,025 | 1/1995 | Sklansky et al. | 273/292 |
| 5,390,934 | 2/1995 | Grassa | 273/292 |
| 5,393,067 | 2/1995 | Paulsen et al. | 273/292 |
| 5,401,023 | 3/1995 | Wood | 273/292 |
| 5,411,257 | 5/1995 | Fulton | 273/292 |
| 5,417,430 | 5/1995 | Breeding | 463/13 |
| 5,437,462 | 8/1995 | Breeding | 273/292 |
| 5,445,391 | 8/1995 | Gleason, Jr. | 273/304 |
| 5,472,194 | 12/1995 | Breeding et al. | 273/292 |
| 5,489,101 | 2/1996 | Moody | 273/292 |
| 5,494,296 | 2/1996 | Grassa | 273/292 |
| 5,511,781 | 4/1996 | Wood et al. | 463/13 |
| 5,531,448 | 7/1996 | Moody | 273/292 |
| 5,536,016 | 7/1996 | Thompson | 273/269 |
| 5,573,245 | 11/1996 | Weiner et al. | 273/153 R |
| 5,577,731 | 11/1996 | Jones | 273/292 |
| 5,584,485 | 12/1996 | Jones et al. | 273/292 |
| 5,597,162 | 1/1997 | Franklin | 273/292 |
| 5,605,504 | 2/1997 | Huang | 463/22 |
| 5,626,341 | 5/1997 | Jones et al. | 273/292 |
| 5,636,843 | 6/1997 | Roberts | 273/292 |
| 5,664,781 | 9/1997 | Feola | 273/292 |
| 5,695,402 | 12/1997 | Stupak | 463/20 |
| 5,713,573 | 2/1998 | Nazaryan | 273/292 |
| 5,718,631 | 2/1998 | Invencion | 463/19 |
| 5,725,216 | 3/1998 | Jones | 273/292 |
| 5,732,950 | 3/1998 | Moody | 273/292 |
| 5,743,798 | 4/1998 | Adams et al. | 273/292 |
| 5,755,621 | 5/1998 | Marks et al. | 463/42 |
| 5,770,533 | 6/1998 | Franchi | 463/42 |
| 5,772,211 | 6/1998 | Nazaryan et al. | 273/292 |
| 5,775,992 | 7/1998 | Wood et al. | 463/13 |
| 5,785,593 | 7/1998 | Wood et al. | 463/13 |
| 5,788,241 | 8/1998 | Ung | 273/292 |
| 5,794,964 | 8/1998 | Jones et al. | 273/292 |
| 5,795,225 | 8/1998 | Jones et al. | 273/292 |
| 5,803,809 | 9/1998 | Yoseloff | 463/13 |
| 5,810,361 | 9/1998 | Kadlic | 273/292 |
| 5,823,873 | 10/1998 | Moody | 463/13 |
| 5,839,730 | 11/1998 | Pike | 273/292 |
| 5,839,731 | 11/1998 | Feola | 273/292 |
| 5,842,698 | 12/1998 | Brown | 273/292 |
| 5,845,906 | 12/1998 | Wirth | 273/274 |
| 5,851,147 | 12/1998 | Stupak et al. | 463/13 |
| 5,851,148 | 12/1998 | Brune et al. | 463/25 |
| 5,868,618 | 2/1999 | Netley et al. | 463/13 |
| 5,868,619 | 2/1999 | Wood et al. | 463/13 |
| 5,882,259 | 3/1999 | Holmes, Jr. et al. | 463/13 |
| 5,882,260 | 3/1999 | Marks et al. | 463/13 |

FOREIGN PATENT DOCUMENTS

| | | |
|---|---|---|
| 1334983 | 3/1995 | (CA) . |
| 1335381 | 4/1995 | (CA) . |
| 2830216 | 1/1980 | (DE) . |

| | | |
|---|---|---|
| 3003376 | 8/1981 | (DE) . |
| 68909992 | 4/1989 | (DE) . |
| 4792 | 6/1991 | (DO) . |
| 4793 | 6/1991 | (DO) . |
| 4825 | 3/1993 | (DO) . |
| 4999 | 9/1993 | (DO) . |
| 03384029 | 4/1989 | (EP) . |
| 2083936 | 3/1982 | (GB) . |
| 2097570 | 11/1982 | (GB) . |
| 2177610 | 7/1985 | (GB) . |
| 2169736 | 7/1986 | (GB) . |
| 2184029 | 6/1987 | (GB) . |
| 0338644 | 4/1989 | (IT) . |
| 135187 | 6/1988 | (JP) . |
| 4-371186 | 6/1991 | (JP) . |
| 93/10869 | 6/1993 | (WO) . |
| 94/15684 | 7/1994 | (WO) . |
| 95/21665 | 8/1995 | (WO) . |
| 97/13562 | 4/1997 | (WO) . |
| 92/20417 | 11/1997 | (WO) . |

OTHER PUBLICATIONS

Winning Gamer, Issue #19, Apr. 1986, Pi Yee Press, La Jolla, CA.
Winning Gamer, Issue #20, May 1986, Pi Ye Press, La Jolla, CA.
Winning Gamer, Issue #21, Jun. 1986, Pi Ye Press, La Jolla, CA.
Affidavit of John F. Acres, Oct. 4, 1993.
Affidavit of William Randal Adams, Oct. 4, 1993.
Affidavit of Derell M. Johns, Nov. 19, 1993.
Affidavit of Terry Oliver, Nov. 22, 1993.
Affidavit of Nick Edward Greenwood, Nov. 23, 1993.
Affidavit of Michael Spencer Stone, Nov. 23, 1993.
Scarne, Scarne's Encyclopedia of Games, Harper & Row, N.Y., Copyright 1973, P. 381, 383 and title pages.
Scarne, Scarne's Encyclopedia of Games, Harper & Row, N.Y., Copyright 1973, p. 33–41 and title pages.
Scarne, Scarne's New Completer Guide To Gambling, Simon & Schuster, N.Y., Copyright 1961, p. 440–445.
Scarne, Scarne's Encyclopedia of Games, Harper & Row, N.Y., Copyright 1983, p. 299–305; 383 and title pages.
W.E. Gibson, Hoyle's Modern Encyclopedia of Card Games, p. 218–9, 369–70 (1974).
Casino Player, vol. IV, No. 12, Aug. 1993, "My Biggest Slot Jackpot", Stanford Wong.
Gaming Concepts, Inc. "Over/Under 13 Blackjack" brochure, 1988.
Casino Gaming, September 1988, "Aruba Deals a New Game: Caribbean Stud Poker", p. 12–13.
Casino Journal, vol. 8, No. 12, Dec. 1992, "Working Within the Systems: IGT's linked progressive programs take leap to the tables", p. 10–15, 40, 41.
Casino Journal, vol. 8, No. 6, Jun. 1993, "So You Want to be a Gambler", p. 1, 5.
Las Vegas Sun "A New Game Introduced" Mar. 5, 1982.
Las Vegas Sportsbook "Sklansky Invents New Casino Games" Mar. 19–25, 1982 Vegas World "Casino Poker".
Sklansky "Casino Poker" rule card, TX899,489, copyright Apr. 4, 1982.
Information Disclosure Statement, Apr. 7, 1988, describing "Sklansky's Casino Poker" and "Video Poker" Coin Hopper Model CH–500 and Model No. CH–750–U1 literature Asahi Seiko.
Jan. 26, 1993 Statement of Grounds and Particulars, by John Huxley Ltd., in opposition to Australian Petition for Patent Application No. 628044.
State of New Jersey Casino Control Commission PRN 217205 Civil Action, IGT's Second Amended Peitition for Authorization for the Implementation of the Game of Progressive 21, filed sometime after Aug. 4, 1992.
Review Journal, "Gamblers Take Chance at Million Dollar Payoff" by D.J. Boyer.
Winning Gamer, Issue #17, Feb. 1986, Pi Yee Press, La Jolla CA.
Scarne, Scarne'S Encyclopedia of Games, "Hold'Em", Harper & Row Publishers, Copyright 1973, p. 14–18, 26.
Abercrobe & Fitch, Play Hours, 1960, p. 11, Blackjack Towel.
Scarne, Scarne's Encyclopedia of Games, copyright date unknown, p. 288.
Jim Kilby's Declaration under 37 C.F.R. 1.132.
TXU 184,603, Mar. 30, 1985.
Scarne, Scarne's Guide to Modern Poker, copyright unknown, p. 40, 60–61.
Request for Reexamination, U.S. Patent No. 4,861,041, issued Aug. 29, 1989; date of service, Jun. 20, 1995.
Request for Reexamination, U.S. Patent No. 4,861,041, issued Aug. 29, 1989; date of service, Sep. 2, 1993.
Request for Reexamination, U.S. Patent No. 5,288,077, issued Feb. 22, 1994; date of service, May 26, 1995.
Request for Reexamination, U.S. Patent No. 5,364,105, issued Nov. 15, 1994; date of service, May 29, 1995.
Asahi Seiko Catalog No. AV89C, Aug. 20, 1989; p. 44, 51 and Photograph "A".
Scarnes, Scarne's Encyclopedia of Games, Copyright 1973, p. 11, 31, 440–445.
Declaration of I. Nelson Rose, dated, Jan. 26, 1989.
Declaration of Don Clark, dated Feb. 2, 1989.
Affidavit of Dennis Robie, dated Jan. 27, 1989.
Declaration of Mark A. Sincox, dated. Feb. 7, 1989.
Declaration of John Edward Roethel, dated Feb. 7, 1989.
Commerce Casino Brochure Re Wisted' California Blackjack.
D&D Gaming Patent, Inc. v. Rio Properties, Inc. et al.: Case No. CV–S–93–835–LDG–RLH; Defendants.
Request for Reexamination, U.S. Patent No. 5,377,973, issued Jan. 3, 1995.
PCT Written Opinion US 96/16409.
Royal Match 21 "Win Your Fortune" brochure, copyright 1991.
Fortune Card 21 "Win Your Fortune" brochure, copyright 1991.
Winning Gamer, Issue #17, Feb. 1986.
Over/Under 13 Blackjack brochure.
Official Rules of Card Games, edited by A.H. Morehead, p. 78–93, copyright date 1968.
Specific Model Information Form FO–652–216.
Table Layout for "Casino Poker" Feb. 15, 1992.
TX 2 568 066 for Over/Under 13.
Supplement to Request for Reexam filed Under 1.510 served Mar. 25, 1998.

METHODS OF PLAYING POKER GAMES

CROSS REFERENCE TO RELATED APPLICATIONS

This Application is a continuation of application Ser. No. 08/910,863 filed Aug. 13, 1997 now U.S. Pat. No. 5,964,464, which is a continuation of application Ser. No. 08/542,817 filed Oct. 13, 1995 now U.S. Pat. No. 5,725,216.

This application is generally related to the following applications and patents, each generally directed to methods and apparatus for playing gambling card games and each of which name as an inventor Daniel A. Jones, the named inventor of the instant application:

Application Ser. No. 08/506,222 filed Jul. 24, 1995.

Application Ser. No. 08/486,700 filed Jun. 7, 1995; which is a continuation of application Ser. No. 08/337,661 filed Nov. 9, 1994; which is a division of application Ser. No. 08/040,925 filed Mar. 31, 1993 and now U.S. Pat. No. 5,364,104; which is a division of application Ser. No. 07/800,631 filed Nov. 27, 1991 and now U.S. Pat. No. 5,288,077; which is a continuation in part of application Ser. No. 07/361,276 filed Jun. 5, 1989 and now U.S. Pat. No. 5,078,405; which is a division of application Ser. No. 07/214,934 filed Jul. 5, 1988 and now U.S. Pat. No. 4,861,041; which is a continuation in part of application Ser. No. 07/182,374 filed Apr. 18, 1988 and now U.S. Pat. No. 4,836,553.

Application Ser. No. 08/408,267 filed Mar. 20, 1995; which is a continuation in part of application Ser. No. 08/328,498 filed Oct. 25, 1994; which is also a division of the aforementioned application Ser. No. 08/040,925 filed Mar. 31, 1993 and now U.S. Pat. No. 5,364,104.

Application Ser. No. 08/140,688 filed Oct. 21, 1993 and now U.S. Pat. No. 5,380,012; which is a continuation-in-part of application Ser. No. 08/074,301 filed Jun. 9, 1993 and now U.S. Pat. No. 5,374,067; which is a continuation in part of the aforementioned application Ser. No. 07/800,631, filed Nov. 27, 1991 and now U.S. Pat. No. 5,288,077.

Application Ser. No. 08/195,482 filed Feb. 14, 1994 and now U.S. Pat. No. 5,377,973 is a continuation in part of the aforementioned application Ser. No. 08/040,925 filed Mar. 31, 1993 and now U.S. Pat. No. 5,364,104.

Application Ser. No. 08/195,482 filed Feb. 14, 1994 and now U.S. Pat. No. 5,377,973 is also a continuation in part of application Ser. No. 08/074,301 filed Jun. 9, 1993 and now U.S. Pat. No. 5,374,067.

Application Ser. No. 08/195,482 filed Feb. 14, 1994 and now U.S. Pat. No. 5,377,973 is also a continuation in part of application Ser. No. 08/088,785 filed Jul. 8, 1993 and now U.S. Pat. No. 5,282,025; which is a continuation in part of the above referenced application Ser. No. 07/800,631 filed Nov. 27, 1991 and now U.S. Pat. No. 5,288,077.

Application Ser. No. 08/078,602 filed Jun. 16, 1993 and now U.S. Pat. No. 5,364,105; which is a continuation of the aforementioned application Ser. No. 07/800,631 filed Nov. 27, 1991 and now U.S. Pat. No. 5,288,077.

Application Ser. No. 07/443,884 filed Nov. 27, 1989 and now U.S. Pat. No. 4,948,134; which is a division of application Ser. No. 07/218,152 filed Jul. 13, 1988 and now U.S. Pat. No. 5,022,653; which is a continuation in part of the aforementioned application Ser. No. 182,374 filed Apr. 18, 1988 and now U.S. Pat. No. 4,836,553.

Application Ser. No. 07/814,712 filed Dec. 30, 1991 and now U.S. Pat. No. 5,377,994.

Application Ser. No. 07/701,670 filed May 16, 1991 and now U.S. Pat. No. 5,112,060.

Application Ser. No. 07/176,384 filed Mar. 31, 1988 and now U.S. Pat. No. Des. 311,474.

The entire disclosures of each of the above referenced applications and patents are hereby incorporated by reference herein.

BACKGROUND OF THE INVENTION

The present invention generally relates to casino card games including progressive jackpots. More particularly, it relates to methods and apparatus for playing electronic and live table versions of seven card stud and five card draw poker games, including an optional progressive jackpot feature.

SUMMARY OF THE INVENTION

Tile present invention relates to methods for playing seven card stud and five card draw poker variants including an optional progressive jackpot feature, and more particularly relates to particular variations of the CARIBBEAN STUD (registered trademark) poker variant disclosed in U.S. Pat. No. 4,836,553 and including an optional progressive jackpot component as disclosed in U.S. Pat. Nos. 4,861,041 and 5,078,405.

DETAILED DESCRIPTION OF THE PREFERRED EMBODIMENTS

Figure 1:
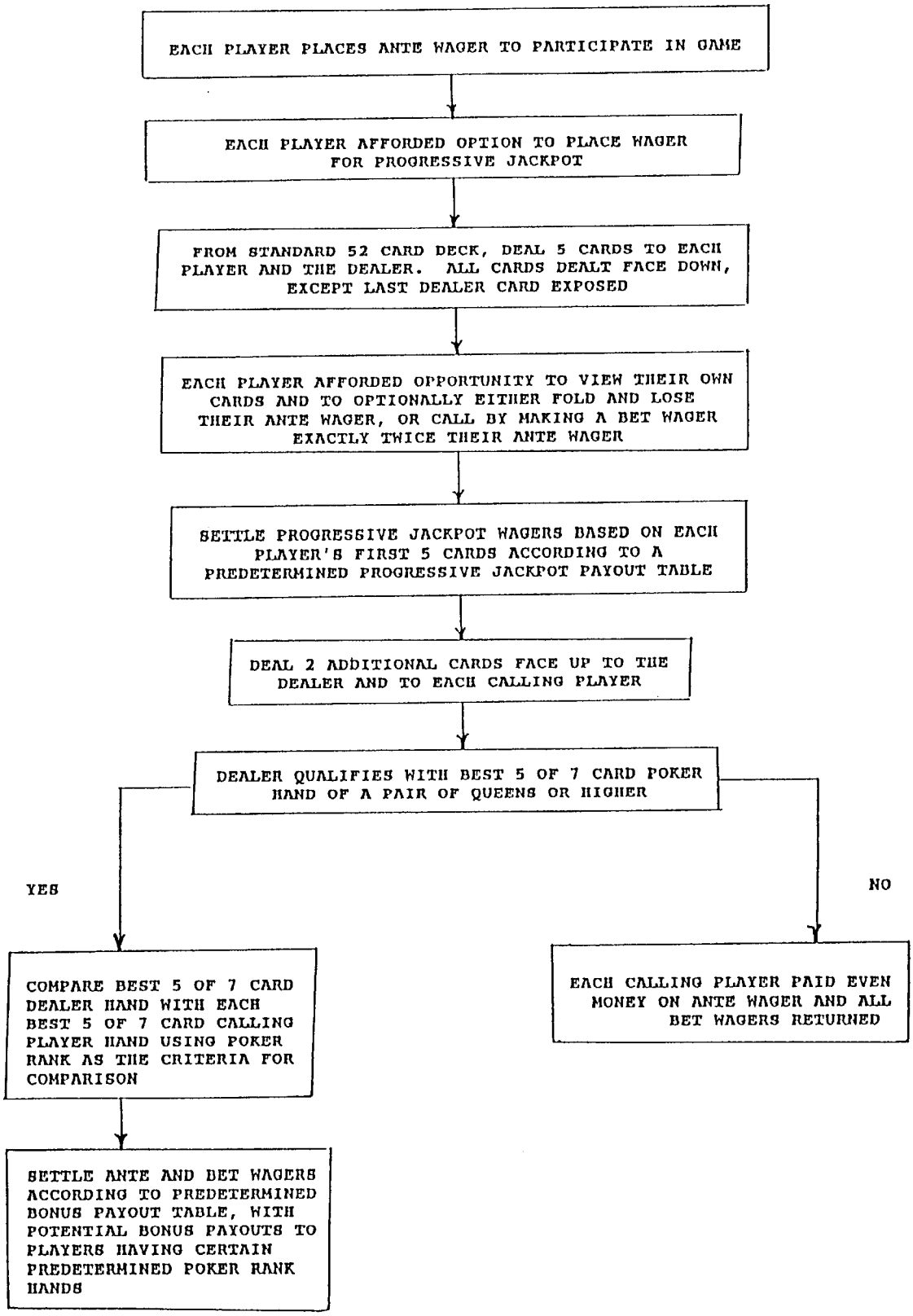
FIG. 1 depicts a flow chart illustrating the manner of play of a seven card stud poker variant including an optional progressive jackpot wager according to a first embodiment of the present invention.

The term "live casino game" is intended to encompass a game in which the house acts as the banker, the house collecting all losing wagers and paying all winning wagers. The dealer is employed by the house and each player plays exclusively against the house.

In the game of Caribbean Stud (TM) poker, as set forth in detail in U.S. Pat. No. 4,836,553, which issued on Jun. 6, 1989 to James P. Suttle and Daniel A. Jones, any number of decks of cards may be used, but in the preferred embodiment, a single deck of standard playing cards is used which is reshuffled after each round is played. The dealer shuffles the cards, each player makes an ante by placing a token or chip in a designated ante area, and then the dealer deals one card at a time to each player and then one card to himself until each player and the dealer has a five card hand. All of each player's cards are dealt face down, while four of the dealer's cards are dealt face down and the other card face up.

Each player may look at his five card hand and each player then decides whether his five card hand has a favorable probability of ultimately beating the dealer's five card hand. The player is assisted in this determination because the player can see one of the dealer's cards.

The priority of winning hands is determined by the conventional rules of poker. As is known to those skilled in the art, five card poker hands are ranked according to the following order with a Royal Flush being the highest winning hand:

1. Royal Flush
2. Straight Flush
3. Four of a Kind
4. Full House
5. Flush
6. Straight
7. Three of a Kind
8. Two Pair
9. One Pair
10. High Card in Hand If a player determines that his hand will not beat the dealer's hand, the player folds or drops, i.e., discontinues playing that hand. The dealer wins the player's ante and takes the player's token from the ante area on the playing surface and places it in a chip rack.

If the player determines that his hand may beat the dealer's hand, then the player indicates his willingness to continue play by placing a bet in a bet area on the playing surface. The bet made by the player is preferably equal to a multiple (e.g., double) of whatever the player originally anted.

After each player has either bet or folded, all cards are turned face up. Each remaining player places his five card hand in front of him on the playing surface while the dealer's cards are all turned face up in front of the dealer on the playing surface.

If the dealer does not have a poker hand at least equal to a predetermined rank or minimum play level, e.g., an Ace-King combination or better, the game does not go forward, and the dealer pays each remaining player a predetermined amount, e.g., one-to-one odds on the amount of the player's ante. The amount of the player's bet is simply returned to the player. All cards are collected, the dealer shuffles the cards and the next round can be played.

If the dealer has a poker hand of at least the preselected rank or minimum (Ace-King or better), then play proceeds and each remaining player's hand is compared to the dealer's hand. If the dealer's hand is higher based on the conventional priority or ranking of five card poker hands, then the dealer wins and he collects both the player's ante and bet. If the dealer's and player's hands are equal, the hand is ruled a tie and the player keeps his bet and his ante.

If the player's hand is higher, the player wins and the dealer pays the player a first predetermined amount, e.g., one-to-one odds, on the amount of the player's ante regardless of the type of poker hand the player has. The dealer also pays the winning player a second predetermined amount, e.g., one-to-one odds on his bet unless the player has received a hand which exceeds a minimum win level, in which case, instead of paying one-to-one odds, the dealer pays the player a bonus payment on the amount of the player's bet based on the type of poker hand that the player has.

The Caribbean Stud (TM) Poker game has been provided with an optional progressive jackpot component, the construction and manner of operation of which is described in detail in U.S. Pat. Nos. 4,861,041 and 5,078,405, the entire disclosures of which are incorporated by reference herein.

In the first embodiment of the present invention, a method of playing a seven card stud variation of the previously described five card stud poker Caribbean Stud (TM) game is disclosed. With reference to FIG. 1, each player places a first or ante wager to participate in the underlying poker game, and is then afforded an option to place a second wager to participate ill an optional progressive jackpot. After the first and second wager options, a dealer deals five cards to each player and also to the dealer, all face down except for the last dealer card, which is turned face up or exposed. Each player is then afforded an opportunity to secretly view their own five cards (and the one exposed card in the dealer's hand) and given the option to either fold and lose their ante wager, or call and continue play by placing a bet wager, which preferably must be exactly twice the initial ante wager, the minimum and maximum amount of which is set by the house or casino. At this step of play, any player having a predetermined winning arrangement of cards which qualifies to win a portion of the progressive jackpot is also paid on the optional jackpot wager according to a predetermined payout table, set forth hereinafter. After the settling of the progressive jackpot wagers and after the call or fold option, the dealer deals an additional two cards face up to each calling player and to the dealer. If the dealer does not achieve a best five of seven card poker hand having a poker rank of at least a pair of Queens, then the dealer does not qualify, and each calling player wins their ante wager and all bet wagers are returned. If the dealer qualifies with at least a pair of Queens, then each player's best five of seven card poker hand is compared with the dealer's best five of seven card poker hand. If the dealer wins versus a particular player, the dealer wins even money on the ante and bet wagers. If any particular player wins versus the dealer, the player is paid even money on the ante wager and is also paid on the bet wager according to a predetermined bonus payoff table set forth hereinafter. When a particular player's hand is the same poker rank as the dealer's poker hand, there is a push, and the particular player retains their ante and bet wagers. After settlement, the dealer deals the next hand.

The preferred predetermined winning card arrangements and associated payoff amounts for the progressive jackpot are as set forth below, based upon a $1.00 progressive jackpot wager:

TABLE 1

| Winning Hand | Amount of Jackpot |
|---|---|
| Royal Flush | 100% (first highest) |
| Straight Flush | 10% (second highest) |
| Four of a Kind | $500.00 (third highest) |
| Full House | $100.00 (fourth highest) |
| Flush | $50.00 (fifth highest) |

The bonus payment on the bet wager is preferably paid according to the following preferred bonus payment schedule:

TABLE 2

| Type of Hand | Bonus Payment Odds |
|---|---|
| Royal Flush | 100-to-1 |
| Straight Flush | 40-to-1 |
| Four of a Klnd | 7-to-1 |
| Full House | 3-to-1 |
| Flush | 2-to-1 |
| Straight | 2-to-1 |
| Three of a Kind | 2-to-1 |

After the dealer has paid the winning players and collected from the losing players, the cards are gathered up, the dealer shuffles the cards and the next round can be played. While the bonus payment odds in the above table are a preferred example of a payout schedule, different odds can be used within the spirit of the invention.

Figure 2:
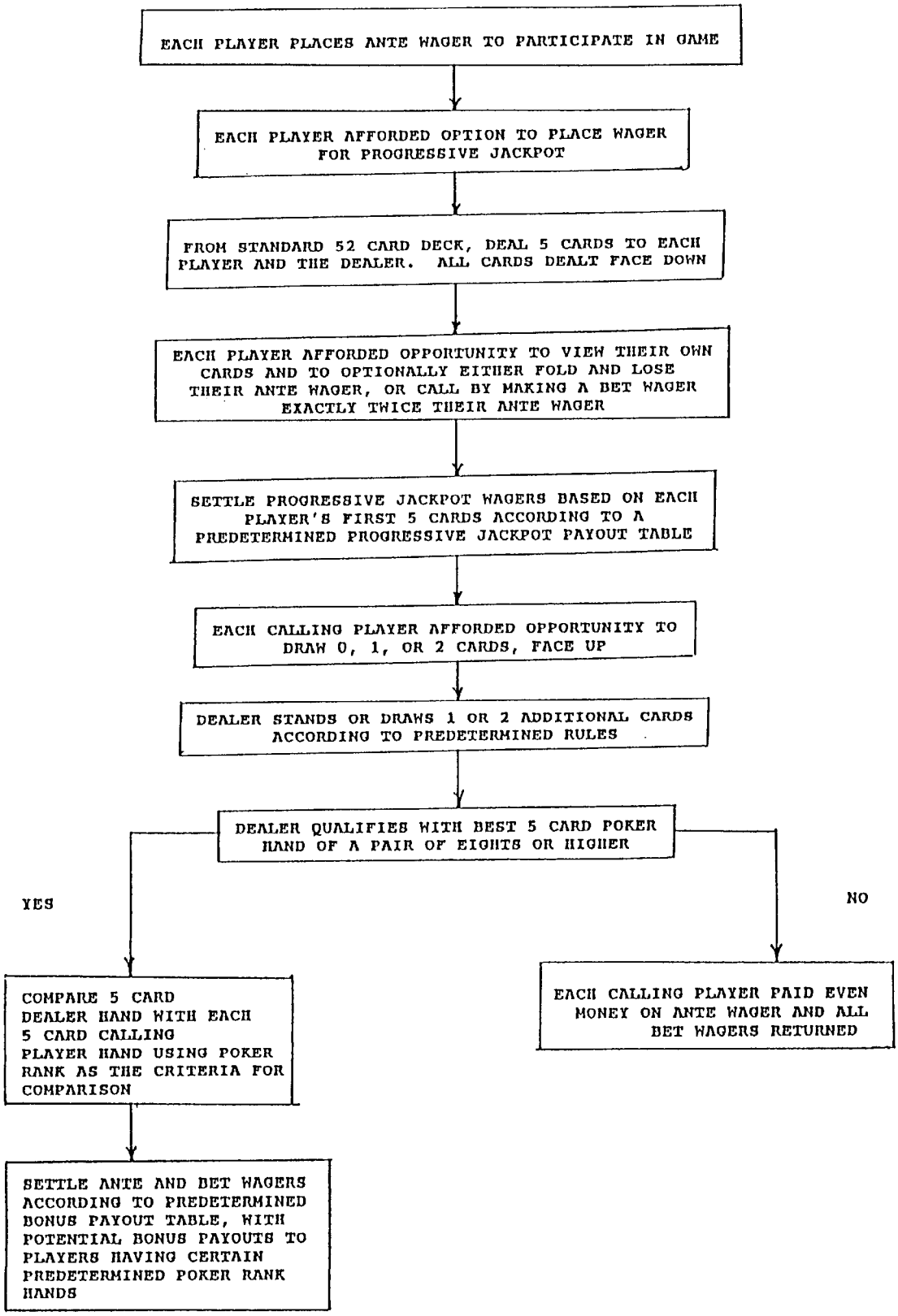
FIG. 2 depicts a flow chart illustrating the manner of play of a five card draw poker variant including an optional progressive jackpot wager according to a first embodiment of the present invention.

In the second embodiment of the present invention, a method of playing a five card draw variation of the previously described five card stud poker Caribbean Stud (TM)

game is disclosed. With reference to FIG. 2, each player places a first or ante wager to participate in the underlying poker game, and is then afforded an option to place a second wager to participate in an optional progressive jackpot. After the first and second wager options, a dealer deals five cards to each player and also to the dealer, all face down. Each player is then afforded an opportunity to secretly view their own five cards and given the option to either fold and lose their ante wager, or call and continue play by placing a bet wager, which preferably must be exactly twice the initial ante wager, the minimum and maximum amount of which is set by the house or casino. At this step of play, any player having a predetermined winning arrangement of cards which qualifies to win a portion of the progressive jackpot is also paid on the optional jackpot wager according to a predetermined payout table, set forth hereinafter. After the settling of the progressive jackpot wagers and after the call or fold option, each calling player has the option to draw zero, one, or two cards. Each player must discard one or two cards prior to drawing. Cards drawn are dealt face up by the dealer.

After all betting players have received their additional draw cards, then the dealer turns his or her five cards face up and decides to stand or to draw either one or two cards based upon the following predetermined procedure according to poker rank:

stand on: straight flush; straight; four of a kind; or full house draw one card on: four card straight; four card flush; three of a kind (keeping higher of the other two cards); two pair (keeping both pairs)

draw two cards on: any pair (keeping the highest of the other three cards); if the hand includes a pair as well as a four card straight or a four card flush, then the dealer must still keep the pair and the highest of the other three cards; example: 2D 2H 3H 4H 5H, the dealer then keeps 2D 2H 5H and discards 3H and 4H); no pairs (the dealer then discards the lowest two cards).

The dealer discards the appropriate cards as determined by the above predetermined rules and deals himself face up either zero, one, or two cards. If the dealer does not achieve a best five card poker hand having a poker rank of at least a pair of eights, then the dealer does not qualify, and each calling player wins their ante wager and all bet wagers are returned. If the dealer qualifies with at least a pair of eights, then each player's best five card poker hand is compared with the dealer's best five card poker hand. If the dealer wins versus a particular player, the dealer wins even money on the ante and bet wagers. If any particular player wins versus the dealer, the player is paid even money on the ante wager and is also paid on the bet wager according to a predetermined bonus payoff table set forth hereinafter. When a particular player's hand is the same poker rank as the dealer's poker hand, there is a push, and the particular player retains their ante and bet wagers. After settlement, the dealer deals the next hand.

The preferred predetermined winning card arrangements and associated payoff amounts for the progressive jackpot are as set forth below, based upon a $1.00 progressive jackpot wager:

TABLE 3

| Winning Hand | Amount of Jackpot |
|---|---|
| Royal Flush | 100% (first highest) |
| Straight Flush | 10% (second highest) |

TABLE 3-continued

| Winning Hand | Amount of Jackpot |
|---|---|
| Four of a Kind | $500.00 (third highest) |
| Full House | $100.00 (fourth highest) |
| Flush | $50.00 (fifth highest) |

The bonus payment on the bet wager is preferably paid according to the following preferred bonus payment schedule:

TABLE 4

| Type of Hand | Bonus Payment Odds |
|---|---|
| Royal Flush | 100-to-1 |
| Straight Flush | 40-to-1 |
| Four of a Klnd | 7-to-1 |
| Full House | 3-to-1 |
| Flush | 2-to-1 |
| Straight | 2-to-1 |
| Three of a Kind | 2-to-1 |

After the dealer has paid the winning players and collected from the losing players, the cards are gathered up, the dealer shuffles the cards and the next round can be played. While the bonus payment odds in the above table are a preferred example of a payout schedule, different odds can be used within the spirit of the invention.

The methods of play according to the first and second embodiments of the present invention can also be implemented on an electronic video type gaming device, of the same general type disclosed in U.S. Pat. Nos. 4,948,134; 5,022,653; 5,377,973; 5,374,067; and 5,382,025. In the electronic version, the hand(s) of the player(s) and the DEALER/BANKER take the form of video representations of playing cards displayed on a screen, under the control of a microprocessor operating under a suitable program. Additionally, the game may be implemented in a manner to allow a player the option to play (1) only the underlying poker game; (2) both the underlying game and the progressive jackpot; or (3) only the progressive jackpot component, as disclosed in U.S. Pat. No. 5,377,973.

In both the live table and electronic versions, a plurality of games may be linked to a common progressive jackpot, in order to cause the jackpot to increase more rapidly and thus generate greater player excitement and interest in play.

Other variations or modifications will be apparent to those skilled in the art. Accordingly, the invention should not be limited by the foregoing description, but rather should be defined only by the following claims.

What is claimed is:

1. A method of playing a casino poker card game, comprising the steps of:

(a) affording each player an opportunity to place an ante wager to participate in said card game;

(b) dealing a dealer hand and a hand to each player, said hands each comprising a predetermined number of cards;

(c) after step (b), performing only once the step of affording each player an option of either folding in which case the player surrenders the ante wager, or of calling by placing a bet wager while prohibiting the player from placing any wagers subsequent to the bet wager.

(d) after step (c), affording each remaining player and the dealer an option to either stand or discard and draw at least one card;

(e) comparing each remaining player hand with the dealer hand using poker rank as the criterion for comparison;

(f) if the dealer's hand is not at least a predetermined rank, the player wins a preselected amount based on the player's ante wager and the player keeps the player's bet wager;

(g) if the dealer's hand is at least a predetermined poker rank, and the dealer's hand is higher than the player's hand, the player loses both the player's ante wager and the player's bet wager; and (h) if the dealer's hand is at least a predetermined rank, and the player's hand is higher than the dealer's hand, then the player wins a first predetermined amount on the player's ante wager and the player wins a second predetermined amount on the player's bet wager based on the type of poker hand combination the player has.

2. The method of claim 1, wherein said predetermined number of cards in step (b) is five.

3. The method of claim 1, wherein said dealer hand is dealt face down.

4. The method of claim 1, wherein said player hand is dealt face down.

5. The method of claim 1, wherein any card drawn by a player is dealt face up.

6. The method of claim 1, wherein all cards in step (b) are dealt face down.

7. The method of claim 1, wherein said predetermined poker rank of said dealer's hand is at least a pair of eights.

8. The method of claim 1, further comprising the steps of:

affording each player an option of placing a progressive jackpot wager to participate in a progressive jackpot; and settling said progressive jackpot wagers based on each player's hand according to a predetermined progressive jackpot payout table.

9. The method of claim 8, where said progressive jackpot payout table substantially comprises:

| Winning Hand | Amount of Jackpot |
|---|---|
| Royal Flush | 100% |
| Straight Flush | 10% |
| Four of a Kind | $500.00 |
| Full House | $100.00 |
| Flush | $50.00 |

10. The method of claim 1, wherein said second predetermined amount paid in step (h) on the player's bet wager is paid substantially according to the following payout table depending on the poker rank of the player's hand:

| Winning Hand | Amount |
|---|---|
| Royal Flush | 100-to-1 |
| Straight Flush | 40-to-1 |
| Four of a Klnd | 7-to-1 |
| Full House | 3-to-1 |
| Straight | 2-to-1 |
| Three of a Kind | 2-to-1 |

11. A method of playing a casino poker card game, comprising the steps of:

(a) affording each player an opportunity to place an ante wager to participate in said card game;

(b) dealing a dealer hand and a hand to each player, said hands each comprising a predetermined number of cards;

(c) after step (b), performing only once the step of affording each player an option of either folding, in which case the player surrenders the ante wager, or of calling by placing a bet wager while prohibiting the player from placing any wagers subsequent to the bet wager;

(d) after step (c), affording each remaining player the option to discard and draw one or more cards;

(e) comparing each remaining player hand with the dealer hand using poker rank as the criterion for comparison to determining winning players; and (f) settling said wagers.

12. The method of-claim 4, wherein said predetermined number of cards in step (b) is five.

13. The method of claim 4, wherein said dealer hand is dealt face down.

14. The method of claim 4, wherein said player hand is dealt face down.

15. The method of claim 4, wherein any card drawn by a player is dealt face up.

16. The method of claim 4, wherein all cards in steps (d) and (e) are dealt face down.

17. The method of claim 4, further comprising the steps of:

affording each player an option of placing a progressive jackpot wager to participate in a progressive jackpot; and settling said progressive jackpot wagers based on each player's hand according to a predetermined progressive jackpot payout table.

18. A method of playing a house banked casino poker card game, comprising the steps of:

(a) dealing five cards to at least one player and a dealer;

(b) after step (a), performing only once the step of affording said player the option to fold, or to call by placing a wager and either standing or discarding and drawing at least one card while prohibiting the player from placing any wagers after the call wager.

(c) after step (b), affording said dealer the option to either stand or discard and draw at least one card;

(d) comparing each remaining player's best five card hand to the dealer's best five card hand using poker rank as the criterion for comparison;

(e) if the dealer's hand is not at least a predetermined rank, the player keeps the player's wager;

(f) if the dealer's hand is at least a predetermined rank; and the dealer's hand is higher than the player's hand, the player loses the player's wager; and (g) if the dealer's hand is at least a predetermined rank, and the player's hand is higher than the dealer's hand, the player wins a predetermined amount on the player's wager based on the poker rank of the player's hand.

* * * * *